US007546836B2

(12) United States Patent
Andersson et al.

(10) Patent No.: US 7,546,836 B2
(45) Date of Patent: Jun. 16, 2009

(54) IGNITION MODULE FOR USE WITH A LIGHT-DUTY INTERNAL COMBUSTION ENGINE

(75) Inventors: Martin N. Andersson, Caro, MI (US); Cyrus M. Healy, Ubly, MI (US)

(73) Assignee: Walbro Engine Management, L.L.C., Tucson, AZ (US)

( * ) Notice: Subject to any disclaimer, the term of this patent is extended or adjusted under 35 U.S.C. 154(b) by 0 days.

(21) Appl. No.: 12/017,200

(22) Filed: Jan. 21, 2008

(65) Prior Publication Data

US 2008/0178841 A1 Jul. 31, 2008

Related U.S. Application Data

(60) Provisional application No. 60/897,565, filed on Jan. 26, 2007.

(51) Int. Cl.
*F02P 3/06* (2006.01)

(52) U.S. Cl. ..... 123/605; 123/406.56; 123/406.58; 123/599; 123/601

(58) Field of Classification Search ..... 123/406.57, 123/599, 601, 605
See application file for complete search history.

(56) References Cited

U.S. PATENT DOCUMENTS

| | | | | |
|---|---|---|---|---|
| 4,537,174 | A * | 8/1985 | Nagasawa | 123/604 |
| 4,722,311 | A | 2/1988 | Erhard | |
| 4,949,696 | A * | 8/1990 | Muller et al. | 123/601 |
| 5,050,553 | A * | 9/1991 | Erhard | 123/406.54 |
| 5,476,082 | A * | 12/1995 | Carpenter et al. | 123/478 |
| 5,531,206 | A * | 7/1996 | Kitson et al. | 123/596 |
| 5,584,280 | A * | 12/1996 | Kinoshita et al. | 123/406.57 |
| 5,635,801 | A | 6/1997 | Regazzi et al. | |
| 6,138,653 | A * | 10/2000 | Juffinger | 123/598 |
| 6,539,930 | B2 * | 4/2003 | Inagaki | 123/655 |
| 6,701,896 | B2 | 3/2004 | Kiessling | |
| 6,701,904 | B2 * | 3/2004 | Lepley | 123/604 |
| 6,779,517 | B2 * | 8/2004 | Sakakura | 123/630 |
| 7,121,270 | B1 * | 10/2006 | Plotnikov | 123/604 |
| 7,137,385 | B2 * | 11/2006 | Newton | 123/630 |

FOREIGN PATENT DOCUMENTS

| | | |
|---|---|---|
| EP | 601460 A2 | 6/1994 |
| JP | 56032075 | 4/1981 |
| JP | 58131358 | 8/1983 |
| JP | 61255272 | 11/1986 |

* cited by examiner

*Primary Examiner*—Stephen K Cronin
*Assistant Examiner*—David Hamaoui
(74) *Attorney, Agent, or Firm*—Reising Ethington P.C.

(57) ABSTRACT

A capacitive discharge ignition (CDI) system that can be used with a variety of light-duty internal combustion engines, including those typically employed by lawn, garden, and other outdoor equipment. According to one embodiment, the CDI system includes an ignition module having a first switching device that shorts a charge coil during an initial portion of a charge cycle. Subsequently, the first switching device is turned 'off' so that a flyback charging technique charges an ignition capacitor. A second switching device is then used to discharge the ignition capacitor and initiate the combustion process.

25 Claims, 5 Drawing Sheets

120
$x_0$
124
122
$y_0$
ENGINE INPUT SIGNAL

CHARGE CONTROL SIGNAL

CHARGE COIL CURRENT

130
IGNITION CAPACITOR VOLTAGE

DISCHARGE CONTROL SIGNAL $t_0$
$t_1$
$t_2$

IGNITION MODULE FOR USE WITH A LIGHT-DUTY INTERNAL COMBUSTION ENGINE

REFERENCE TO CO-PENDING APPLICATION

This application claims priority to U.S. Provisional Application Ser. No. 60/897,565, filed Jan. 26, 2007, the entire contents of which are incorporated herein by reference.

FIELD OF THE INVENTION

The present invention relates generally to ignition modules and, more particularly, to ignition modules used with capacitive discharge ignition (CDI) systems, such as those employed by lawn, garden, and other outdoor equipment.

BACKGROUND OF THE INVENTION

Capacitive discharge ignition (CDI) systems are sometimes used with small engines, including light-duty internal combustion engines such as those employed by lawn, garden, and other outdoor equipment. In order to provide sufficient ignition voltages during low speed environments, some CDI systems utilize charge coils with higher inductance and resistance characteristics. Although such an arrangement can be beneficial for producing high voltages at lower engine speeds, it can hinder the CDI system's ability to power electrical devices at higher engine speeds.

SUMMARY OF THE INVENTION

According to one aspect, there is provided an ignition module for use with a capacitive discharge ignition (CDI) system. The ignition module comprises: a charge coil, an ignition capacitor, a first switching device, a second switching device, and an electronic processing device coupled to the first and second switching devices. Activation of the first switching device creates a low impedance path between the charge coil and ground.

According to another aspect, there is provided a method of operating an ignition module. The method comprises the steps of: (a) inducing electrical energy in a charge coil, (b) shorting the charge coil during a first stage of a charge cycle, (c) interrupting the short during a second stage of the charge cycle, and (d) charging the ignition capacitor according to a flyback charging technique.

According to another aspect, there is provided a method of operating an ignition module. The method comprises the steps of: (a) inducing electrical energy in a charge coil, (b) using a flyback charging technique to charge an ignition capacitor, wherein the flyback charging technique is used when an engine is operating in a lower speed range, and (c) using a non-flyback charging technique to power an additional electrical device, wherein the non-flyback charging technique is used when the engine is operating in a higher speed range.

BRIEF DESCRIPTION OF THE DRAWINGS

Preferred exemplary embodiments of the invention will hereinafter be described in conjunction with the appended drawings, wherein like designations denote like elements, and wherein.

DETAILED DESCRIPTION OF PREFERRED EMBODIMENTS

The exemplary ignition system described herein is a capacitive discharge ignition (CDI) system that can be used with a variety of light-duty internal combustion engines, including those typically employed by lawn, garden, and other outdoor equipment. According to one embodiment, the ignition system uses an ignition module and a 'flyback' charging technique in a manner that can provide a number of positive features. For example, the ignition system can charge an ignition capacitor and additional electric devices with a single charge coil, it can charge across a wide spectrum of engine speeds, it can power both high voltage and high current devices, and it can have a reduced number of parts, weight, and expense, to name but a few possibilities.

Ignition System

Figure 1:
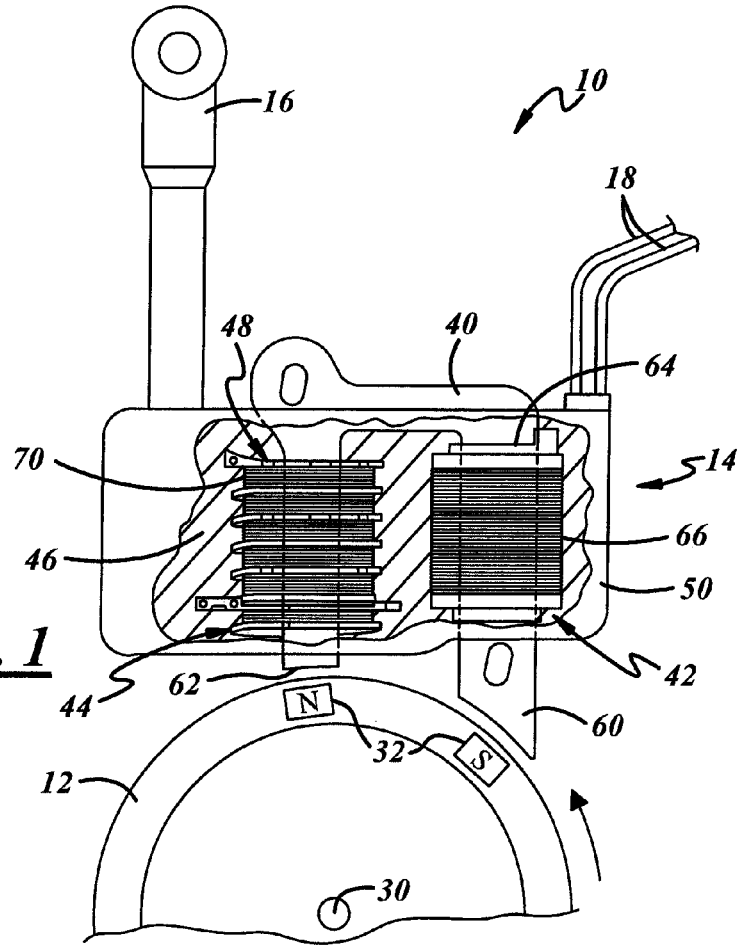
FIG. 1 is a cutaway view showing portions of an exemplary capacitive discharge ignition (CDI) system that can be used with a light-duty internal combustion engine.

With reference to FIG. 1, there is shown a cut-away view of an exemplary capacitive discharge ignition (CDI) system 10 that interacts with a flywheel 12 and generally includes an ignition module 14, an ignition lead 16 for electrically coupling the ignition module to a spark plug (not shown), and electrical connections 18 for coupling the ignition module to one or more additional electric devices, such as a fuel controlling solenoid. Flywheel 12 is a weighted disk-like component that is coupled to a crankshaft 30 and thus rotates under the power of the engine. By using its rotational inertia, the flywheel moderates fluctuations in engine speed in order to provide a more constant and even output. The flywheel 12 shown here includes a pair of magnetic poles or elements 32 located towards an outer periphery of the flywheel. Once flywheel 12 is rotating, magnetic elements 32 spin past and electromagnetically interact with the different windings in ignition module 14, as is generally known in the art.

Ignition module 14 can generate, store, and utilize the electrical energy that is induced by the rotating magnetic elements 32 in order to perform a variety of functions. According to one embodiment, ignition module 14 includes a lamstack 40, a charge coil 42, a trigger coil 44, an ignition circuit 46, a step-up transformer 48, and an ignition module housing 50. Lamstack 40 is preferably a ferromagnetic part that is comprised of a stack of flat, magnetically-permeable, laminate pieces typically made of steel or iron. The lamstack can assist in concentrating or focusing the changing magnetic flux created by the rotating magnetic elements 32 on the flywheel. According to the embodiment shown here, lamstack 40 has a generally U-shaped configuration that includes a pair of legs 60 and 62. Leg 60 is aligned along the central axis of charge coil 42, and leg 62 is aligned along the central axes of trigger coil 44 and transformer 48. When legs 60 and 62 align with magnetic elements 32—this occurs at a specific rotational position of flywheel 12—a closed-loop flux path is created that includes lamstack 40 and magnetic elements 32. Magnetic elements 32 can be implemented as part of the same magnet or as separate magnetic components coupled together to provide a single flux path through flywheel 12, to cite two possibilities. Additional magnetic elements can be added to flywheel 12 at other locations around its periphery to provide additional electromagnetic interaction with ignition module 14.

Charge coil 42 generates electrical energy that can be used by ignition module 14 for a number of different purposes, including charging an ignition capacitor and powering an electronic processing device, to cite two examples. Charge coil 42 includes a bobbin 64 and a winding 66 and, according to one embodiment, is designed to have a relatively low inductance of about 2-10 mH and a relatively low resistance of about 10-50 Ω. In order to achieve these electrical characteristics, winding 66 can be made from 500-1,500 turns of 30-34 gauge copper wire. As a reference, some prior art windings are made from approximately 3,000 turns of 38 gauge wire, giving it an inductance of about 30-100 mH and a resistance of about 150-400 Ω. The electrical characteristics of a particular winding are usually tailored to its specific application. For instance, a charge coil expected to produce high voltage will oftentimes have more turns of finer gauge wire (thus giving it a higher inductance and resistance) so that it can generate a sufficient voltage during startup or other periods of low engine speed. Conversely, a charge coil designed to provide high current will typically have less turns of larger gauge wire (with a corresponding lower inductance and resistance), as this enables it to more efficiently create high current when the engine is running at wide open throttle or during other high engine speed conditions. As will be described in greater detail below, charge coil 42 is used as a sort of universal coil that sufficiently creates both high voltage and high current, and is able to do so across a wide range of engine speeds.

Trigger coil 44 provides ignition module 14 with an engine input signal that is generally representative of the position and/or speed of the engine. According to the particular embodiment shown here, trigger coil 44 is located towards the end of lamstack leg 62 and is adjacent to transformer 48. It could, however, be arranged at a different location on the lamstack. For example, it is possible to arrange both the trigger and charge coils on a single leg of the lamstack, as opposed to arrangement shown here. It is also possible for trigger coil 44 to be omitted and for ignition module 14 to receive an engine input signal from charge coil 42 or some other device.

Transformer 48 uses a pair of closely-coupled windings 68 and 70 to create high voltage ignition pulses that are sent to a spark plug via ignition lead 16. Like the charge and trigger coils described above, the primary and secondary windings of transformer 48 surround one of the legs of lamstack 40, in this case leg 62. As with any step-up transformer, the primary winding 68 has fewer turns of wire than the secondary winding 70, which has more turns of finer gauge wire. The turn ratio between the primary and secondary windings, as well as other characteristics of the transformer, affect the high voltage and are typically selected based on the particular application in which it is used, as is appreciated by those skilled in the art.

Ignition module housing 50 is preferably made from a rigid plastic, metal, or some other material, and is designed to surround and protect the components of ignition module 14. The ignition module housing has several openings to allow lamstack legs 60 and 62, ignition lead 16, and electrical connections 18 to protrude, and are preferably are sealed so that moisture and other contaminants are prevented from damaging the ignition module. It should be appreciated that ignition system 10 is just one example of a capacitive discharge ignition (CDI) system that can utilize ignition module 14, and that numerous other ignition systems and components, in addition to those shown here, could also be used as well.

Ignition Module

Figure 2:
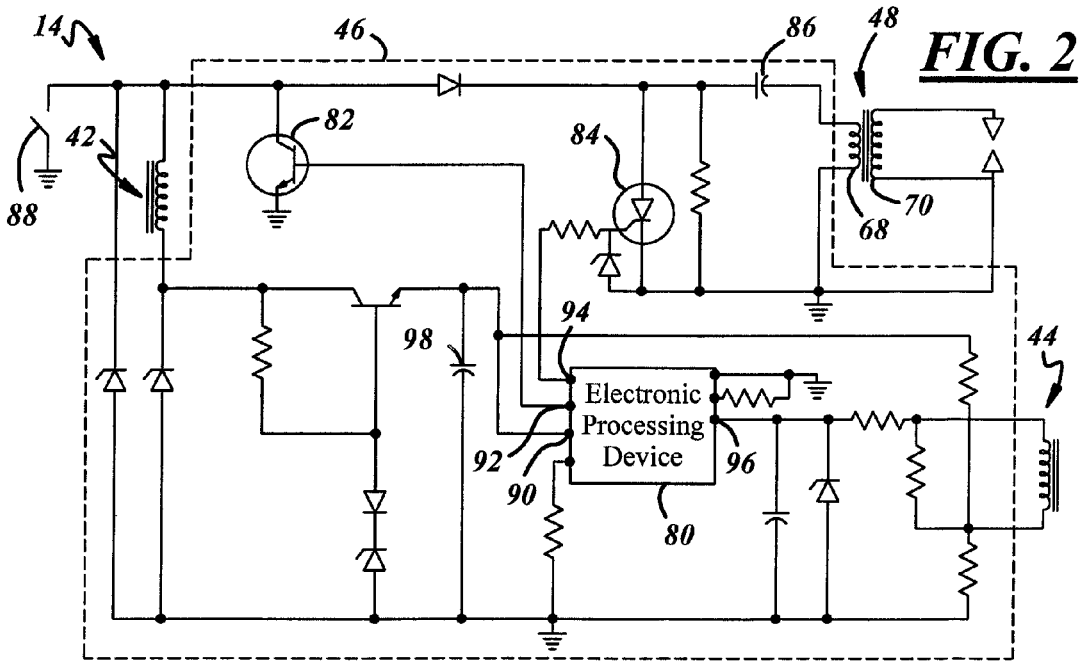
FIG. 2 is a schematic circuit diagram of an exemplary ignition module that can be used with the ignition system of FIG. 1.

Turning now to FIG. 2, there is shown a schematic circuit diagram illustrating some of the components of an exemplary ignition module 14, including a charge coil 42, a trigger coil 44, an ignition circuit 46, and a transformer 48. It should be understood that numerous changes, including the addition, omission and/or substitution of various electrical components, could be made to this diagram as it is merely intended to provide a general overview of one possible implementation. Ignition circuit 46 can be implemented on a printed circuit board (PCB) or other circuit medium known to skilled artisans, and is preferably potted or otherwise hermetically sealed within housing 50. Ignition circuit 46 can utilize a number of different electrical components including, in this embodiment, an electronic processing device 80, a first switching device 82, a second switching device 84, and an ignition capacitor 86. As will be described further below, first switching device 82 can be used as a charge coil clamping switch to implement a flyback charging technique with ignition capacitor 86, whereas second switching device 84 is used to discharge ignition capacitor 86 for spark generation.

Electronic processing device 80 executes various electronic instructions pertaining to a variety of tasks, such as ignition timing control, and can be a microcontroller, a microprocessor, an application specific integrated circuit (ASIC), or any other suitable type of analog or digital processing device known in the art. In the illustrated embodiment, electronic processing device 80 is a microcontroller such as a MSP430 series microcontroller produced by TEXAS INSTRUMENTS, running at 16 MHz with 8 Kb of memory to store information like electronic instructions and variables. The electronic processing device is generally powered by charge coil 42 via various electronic components, including capacitor 98, that smooth or otherwise regulate the energy induced in the charge coil. According to the embodiment shown here, electronic processing device 80 includes the following exemplary input/output arrangement: a power input 90 from charge coil 42, a signal output 92 for providing a charge control signal to first switching device 82, a signal output 94 for providing a discharge control signal to second switching device 84, and a signal input 96 for receiving an engine input signal from trigger coil 44 via a number of signal conditioning circuit components. It should be appreciated that numerous circuit arrangements, including ones other than the exemplary arrangement shown here, could be used to process, condition, or otherwise improve the quality of signals used herein. While the engine input signal on input 96 is schematically shown here as provided in serial fashion on a single input, this and other signals could instead be provided on multiple inputs or according to some other arrangement known in the art. An optional kill switch 88, which acts as a manual override for shutting down the engine, could also be coupled to electronic processing device 80.

First switching device 82 is preferably a high voltage solid state switching device that couples charge coil 42 to ground, and is controlled by the charge control signal sent on output 92. In the embodiment shown here, first switching device 82 is shown as a single bipolar transistor, however, other switching devices could be used. For example, first switching device 82 could instead include a single MOSFET, or a pair of transistors connected in a Darlington arrangement; these are also commercially available as a single integrated circuit (IC) transistor package. In one embodiment, first switching device 82 is designed to handle a voltage of at least 300V and at least 1 Amp of current. When the charge control signal turns 'on' first switching device 82 so that it is conductive, charge coil 42 is shorted to ground. Conversely, when the charge control signal turns first switching device 82 'off', the short is removed and charge coil 42 is free to charge ignition capacitor 86. According to one embodiment, first switching device 82 functions as a clamping switch with a minimum voltage rating of 300V-350V and a minimum current rating of about 1 Amp, and ignition capacitor 86 has a similar voltage rating and a capacitance of about 0.47 μF. As will be subsequently described in more detail, electronic processing device 80 controls the charging of ignition capacitor 86 by controlling first switching device 82 to create a flyback-type effect during the charge cycle.

Second switching device 84 is preferably a high current solid state switching device, such as a silicon controlled rectifier (SCR) or some other type of thyristor, and is designed to discharge ignition capacitor 86 in order to create a spark at the spark plug. In this embodiment, second switching device 84 is part of an energy discharge path that also includes primary winding 68, ignition capacitor 86, and ground. Second switching device 84 is controlled at its gate by the discharge control signal sent on output 94, and is preferably designed to accommodate at least 30 Amps of limited duration current during discharge of ignition capacitor 86. During normal charging conditions, second switching device 84 is turned 'off' so that electrical energy induced in charge coil 42 can charge ignition capacitor 86.

Method of Operation

Figure 3:
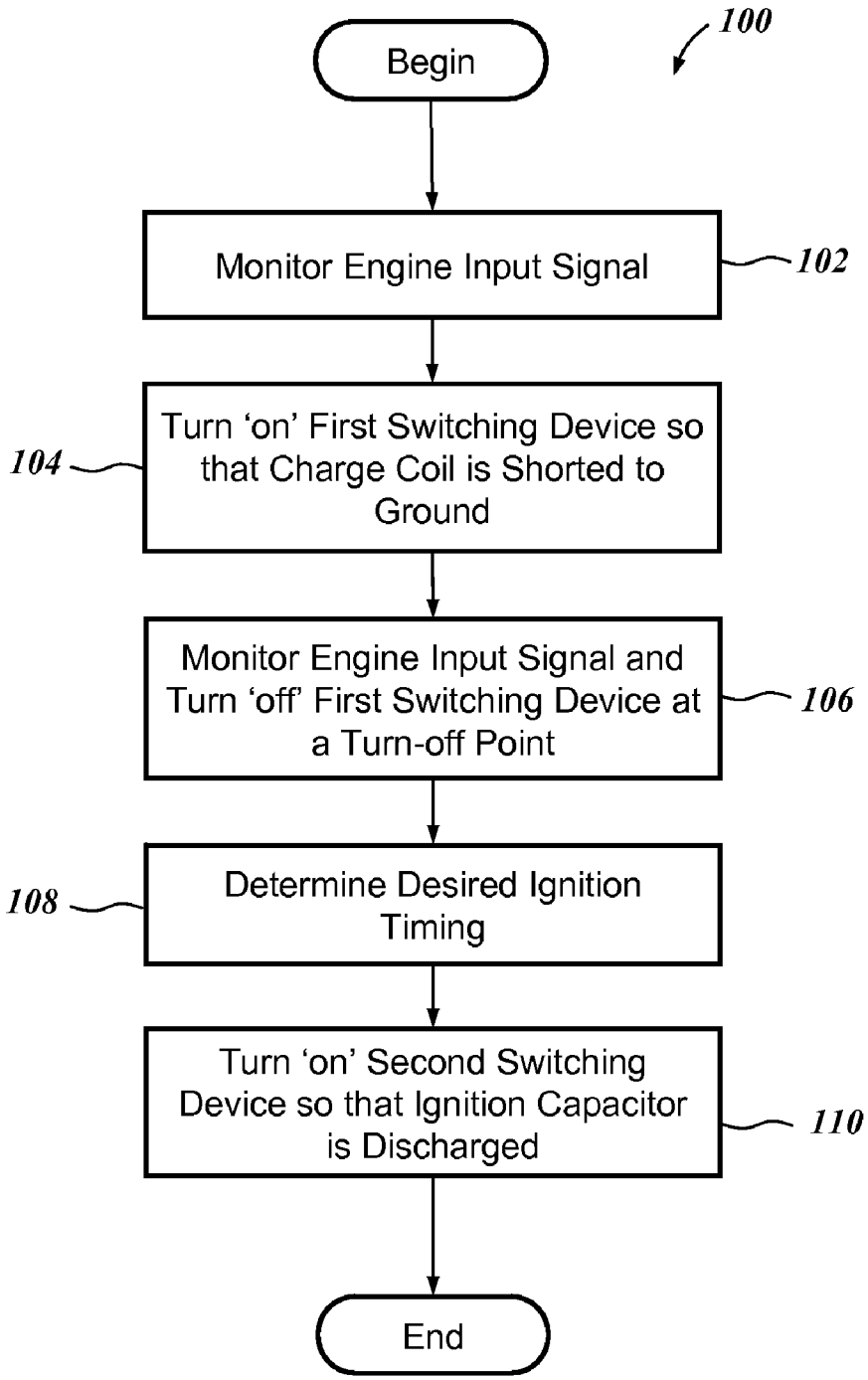
FIG. 3 is a flowchart showing some of the steps of an exemplary method that can be carried out by the ignition module of FIG. 2.
Figures 4A, 4B, 4C, 4D, 4E:
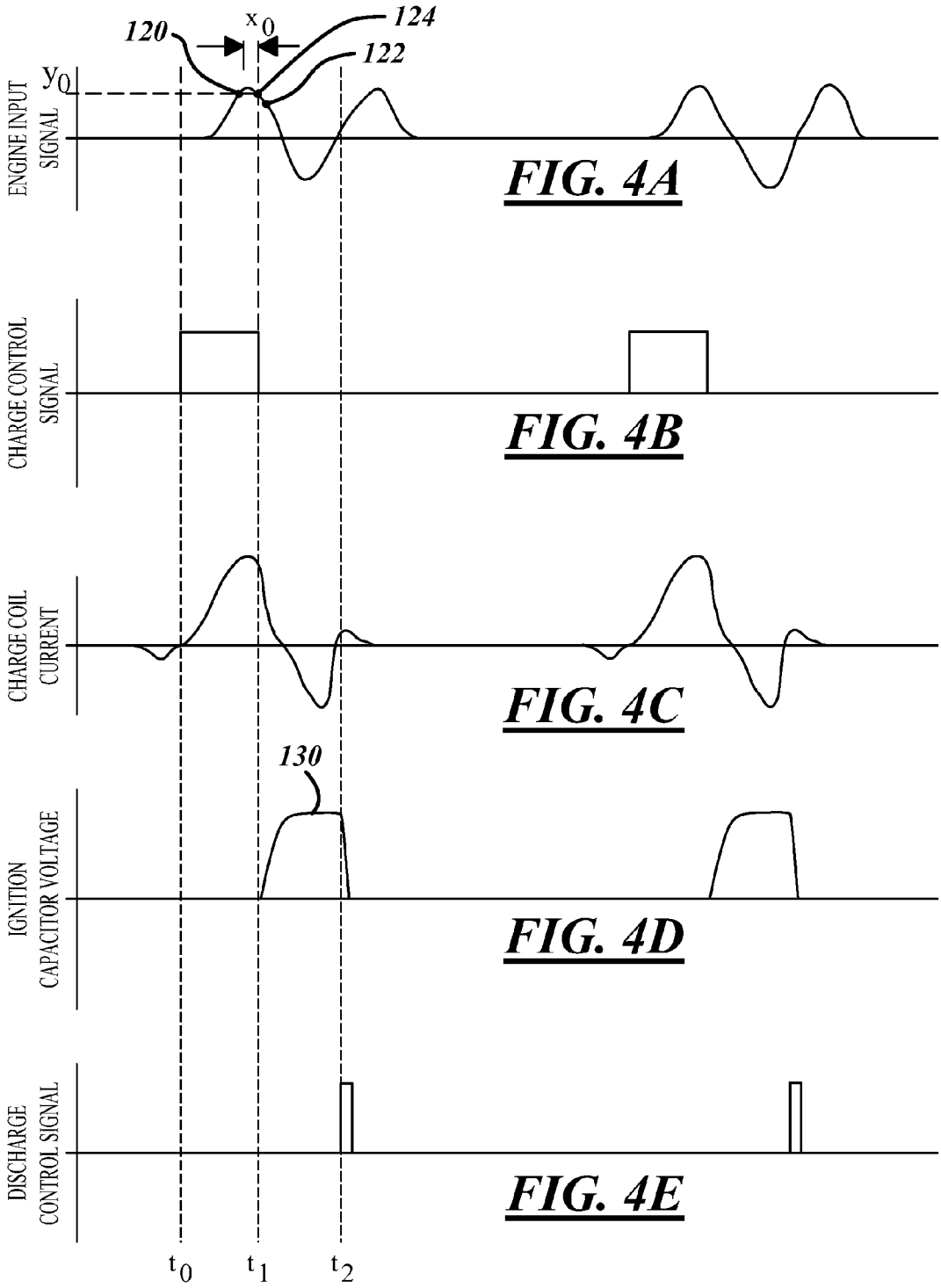
FIGS. 4A-E are timing diagrams of various exemplary signals that can be used during the method described in FIG. 3.

With reference to FIGS. 3-4E, there is provided a flowchart and some timing diagrams to assist in the general explanation of a method 100 for charging ignition capacitor 86; i.e., the charge cycle. In step 102, electronic processing device 80 monitors the engine input signal on input 96 (FIG. 4A) in order to get a reading of the position and/or speed of the engine. The engine input signal is illustrated as a pulse train and can be induced in trigger coil 44 as the magnetic elements 32 rotate past lamstack 40. At a predetermined point, such as at time to, electronic processing device 80 sends a charge control signal (FIG. 4B) to first switching device 82 that causes it to turn 'on', step 104. It should be appreciated that time to can be detected in a variety of ways, including calculating it as a certain amount of time following the previous pulse train of the engine input signal. As first switching device 82 is turned 'on', it provides a low impedance ground path for charge coil 42; effectively shorting the charge coil so that current induced in the coil can flow through the closed switching device 82 to ground. This is illustrated in FIG. 4C, which shows the charge coil current rapidly increasing during the time following the closure of first switching device 82. Due to the shorting of charge coil 42, the charge coil does not charge ignition capacitor 86 during this initial stage of the charge cycle.

Electronic processing device 80 continues to monitor the engine input signal (FIG. 4A) or some other appropriate indicator so that at a time $t_1$ electronic processing device 80 turns 'off' first switching device 82, step 106. For purposes of illustration, the period of time between $t_0$ and $t_1$ is referred to as a first stage of the charge cycle, even though earlier charge cycle stages may exist. According to one embodiment, the engine input signal is analyzed for a turn-off point and, once sensed, electronic processing device 80 turns 'off' first switching device 82 with the charge control signal. It should be appreciated that there are numerous ways for detecting such a turn-off point. For instance, a turn-off point 120 could simply correspond to a predetermined signal level $y_0$ on the engine input signal. The turn-off point could correspond to a point 122 that is a predetermined percentage of the peak signal level of the engine input signal (e.g., 70% of the peak signal level); in this case, the turn-off point 122 occurs after the peak signal level. Alternatively, the turn-off point 124 could correspond to a point on the engine input signal that occurs a certain amount of time $x_0$ following a known reference point like the peak signal level (e.g., 1 ms after the peak signal level), regardless of the level of the engine input signal. It should, of course, be understood that the foregoing examples are only a few of the possibilities for determining a turn-off point, as other methods could also be employed.

At the time that first switching device 82 is turned off, there is a high level of current flowing from charge coil 42, through switching device 82, to ground. The abrupt change or interruption in current flow through charge coil 42 causes a flyback-type event in ignition module 14. Put differently, when first switching device 82 is turned 'off' (open circuit), the current flowing through charge coil 42 is interrupted (FIG. 4C) which results in a collapsing magnetic field. The collapsing magnetic field in turn creates a high voltage output that is redirected and applied to ignition capacitor 86 according to a flyback charging technique. This is evident in FIG. 4D, where ignition capacitor 86 is rapidly charged to an elevated voltage level 130.

Because of this arrangement, a single charge coil 42 can produce both sufficient current at higher engine speeds (this is due to the relatively low-inductance and low-resistance of charge coil 42), and can provide sufficient voltage to capacitor 86 at lower engine speeds (this is primarily due to the high voltage produced during the flyback event). Some prior art ignition modules address the need for high voltage at low engine speeds by simply increasing the number of windings or turns in the coil; however, adding turns usually increases the inductance and resistance of the charge coil and thus makes it less effective for producing current at high engine speeds. Stated differently, the ignition module described herein addresses low engine speed charging concerns without compromising the high speed performance of the charge coil. Throughout the rest of the charging cycle, both of the switching devices 82 and 84 are maintained in an 'off' state so that ignition capacitor 86 can fully charge. For purposes of illustration, the period of time between $t_1$ and $t_2$ is referred to as a second stage of the charge cycle, even though it is possible for additional, intermediate stages to exist between it and the first stage.

As ignition capacitor 86 is being charged, electronic processing device 80 utilizes one or more signal inputs, such as the engine input signal, to determine a desired ignition timing, step 108. As those skilled in the art will appreciate, step 108 can utilize one of a number of different methods and techniques for determining ignition timing, including those disclosed in U.S. Pat. No. 7,000,595, the entire contents of which are hereby incorporated by reference. The particular method or technique used to calculate the ignition timing is not imperative. Once the ignition timing is calculated, electronic processing device 80 sends a discharge control signal to second switching device 84 according to the calculated timing (this usually reflects a certain amount of timing advance or retard with respect to the top-dead-center position of the piston), step 110. The discharge control signal (FIG. 4E) turns on or triggers second switching device 84 at a time $t_2$ so that it rapidly discharges ignition capacitor 86 through primary winding 68, which induces a high voltage ignition pulse in secondary winding 70. The ignition pulse is delivered to a spark plug and arcs across a spark gap, thereby igniting an air/fuel mixture and initiating the combustion process. If at any time during circuit operation kill switch 88 is activated, then electronic processing device 80 generally prevents the ignition pulse from being delivered to the spark plug.

The above-provided description is simply an illustration of one possible embodiment for implementing method 100. Numerous variations on this exemplary method are possible and could instead be used. For instance, first switching device 82 is particularly useful when it is used as a current clamping switch during periods of low engine speed. During low speed periods of the charge cycle, charge coil 42 may otherwise be unable to produce adequate charging voltage for ignition capacitor 86. Thus, method 100 could be modified to check and see when the engine surpasses a predetermined speed, say 6,000 RPMs, at which time a normal uninterrupted charge cycle (no flyback) could be used. When the engine is operating at speeds greater than the predetermined speed, it is usually unnecessary to create the flyback effect described above, as the charge coil is usually producing enough voltage on its own.

Figure 5:
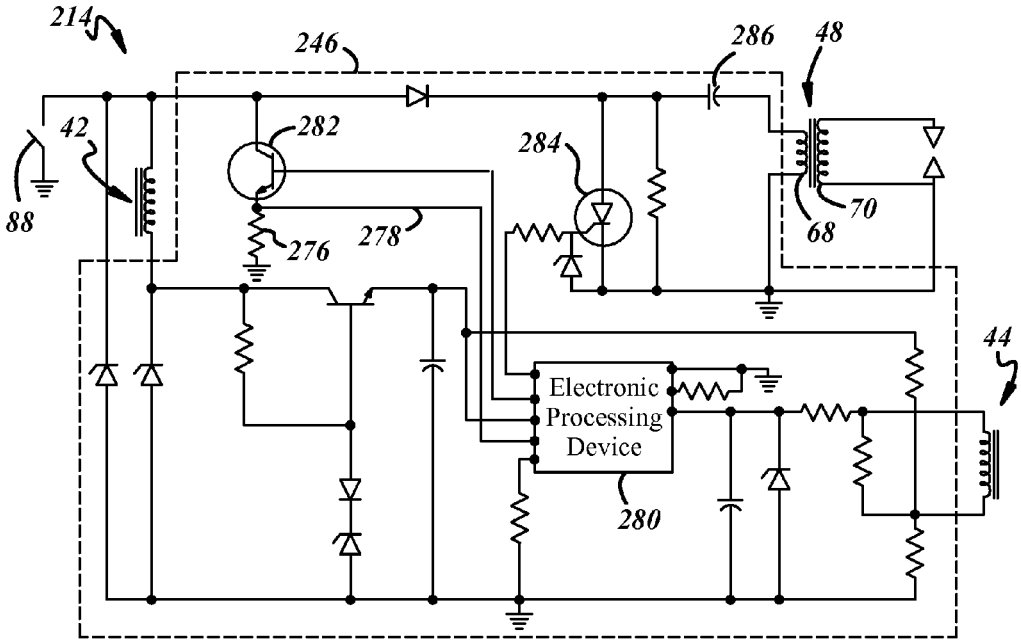
FIG. 5 is a schematic circuit diagram of another exemplary ignition module that can be used with the ignition system of FIG. 1, wherein this embodiment further includes current sensing feedback features.

Turning to FIG. 5, there is shown another ignition module 214 that can be used with the ignition system in FIG. 1, however, this embodiment further includes an ignition circuit 246 with current sensing feedback features to determine when to turn off first switching device 282. As before, first switching device 282 could be provided as a bipolar transistor, in a Darlington arrangement, or as some other type of switch known in the art. Because of similarities with ignition circuit 46, the following discussion is primarily directed to certain pertinent portions of ignition circuit 246; a duplicate discussion of the common components has been omitted. At the beginning of the charge cycle, first switching device 282 is turned on so that charge coil 42 can be shorted through the switching device, as previously described. A current sensing input 278 is connected between a current carrying terminal of first switching device 282 and a grounded resistor 276, and provides electronic processing device 280 with a current feedback signal that is representative of the shorted current flowing through charge coil 42.

As those skilled in the art will appreciate, the arrangement shown in FIG. 5 acts as a sort of voltage divider so that current sensing input 278 can provide electronic processing device 280 with a current feedback signal representative of the current flowing through resistor 276, which in turn is representative of the current through charge coil 42. It is this current feedback signal, as opposed to the engine input signal described before, that electronic processing device 280 utilizes to determine when to turn 'off' first switching device 282 and initiate the flyback event. Once switching device 282 is turned 'off' and the corresponding magnetic field collapses in charge coil 42, the flyback effect dumps high voltage charge on ignition capacitor 286 and continues the charge sequence, as previously explained. The specific techniques used to analyze the current feedback signal and determine the turn-off point can include those previously mentioned (e.g., predetermined signal level, percentage of peak signal level, time following some reference point, etc.), as well as other methods known in the art. Other types of feedback, including feedback representative of current flow through other components of ignition module 214, could also be used.

Figure 6:
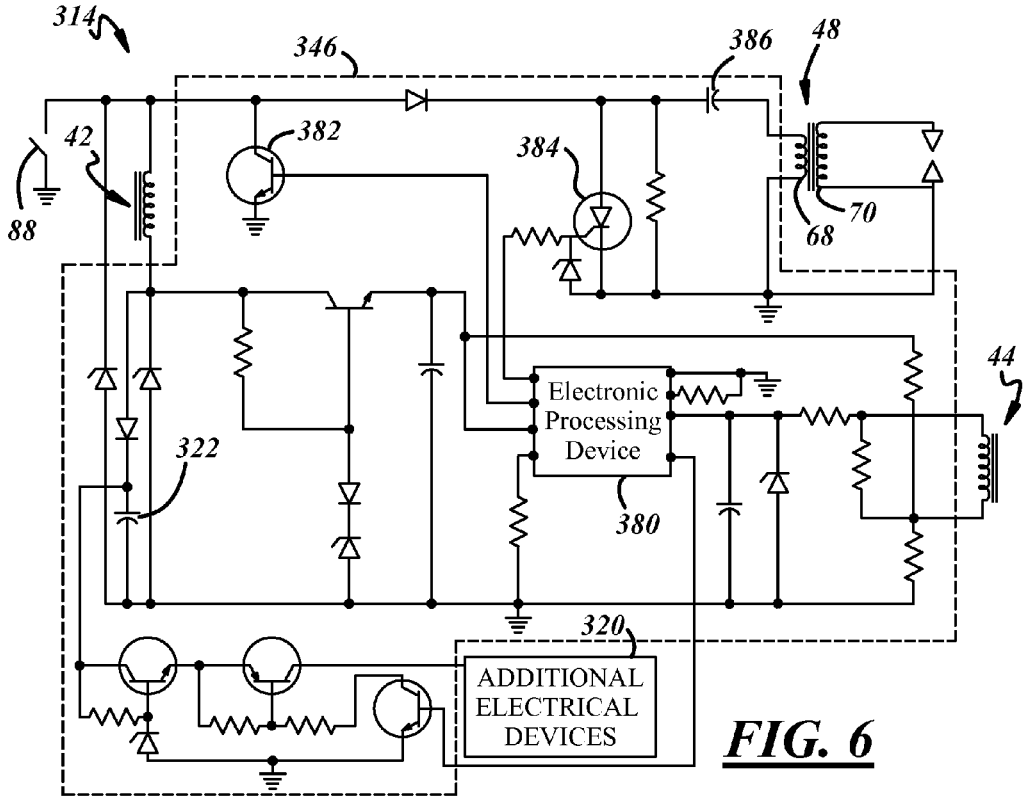
FIG. 6 is a schematic circuit diagram of another exemplary ignition module that can be used with the ignition system of FIG. 1, wherein this embodiment further includes additional electric devices that can also be powered by the charge coil.

Referring to FIG. 6, there is shown another exemplary ignition module 314, however, this embodiment includes one or more additional electrical devices 320 that are also powered by charge coil 42 and are controlled by electronic processing device 380. The upper half of ignition module 314 including first switching device 382, second switching device 384, ignition capacitor 386, etc. can be similar to those embodiments previously described. In addition, ignition module 314 can also include circuitry for driving the additional electrical device 320; which in this case, is an air/fuel ratio controlling solenoid. It should be appreciated, however, that other electrical devices may be used in addition to or in lieu of the solenoid; examples include additional electronic processing devices, electronic motor controllers, electric actuators, electronic throttle governors, etc. Moreover, these additional electric devices can be internal or external to circuit 346.

With reference back to FIG. 4C, the waveform representing the charge coil current includes negative portions where the polarity in charge coil 42 is reversed. Ignition module 314 can use these periods of reversed polarity to charge an energy storage device 322, which can be an electrolytic capacitor or a battery, for example. Once properly charged, energy storage device 322 can provide power for additional electrical device 320. Some electrical devices, like the solenoid, may require higher amounts of power (typically in the range of 0.5 Watts) than is usually required by ignition capacitor 386. As previously explained, charge coil 42 utilizes a low impedance/low resistance construction that is equipped to supply these higher current and/or power demands. For more information regarding the control of an air/fuel ratio solenoid, reference is made to U.S. Pat. No. 7,000,595, which is noted above.

Testing has shown that the ignition system, modules, and methods described herein can significantly increase or otherwise improve the spark ignition voltage at lower engine speeds and the power output at higher engine speeds. A 2-cycle, single cylinder spark ignition engine utilizing the present ignition module is believed to have significantly increased power output in the lower engine speed range of about 300 RPM to 3,500 RPM, and more particularly in the range of about 300 RPM to 2,500 RPM. Likewise, the same ignition module demonstrates improved power output at high engine speeds in the range of 8,000 RPM and greater, and more particularly in the range of about 8,000 RPM to 11,000 RPM. Some of these results are illustrated in FIG. 7, which is a graph showing a relationship between engine speed (RPMs) on the horizontal or x-axis and ignition spark output (KVs) on the vertical or y-axis for the 2-cycle, single cylinder internal combustion engine mentioned above.

Figure 7:
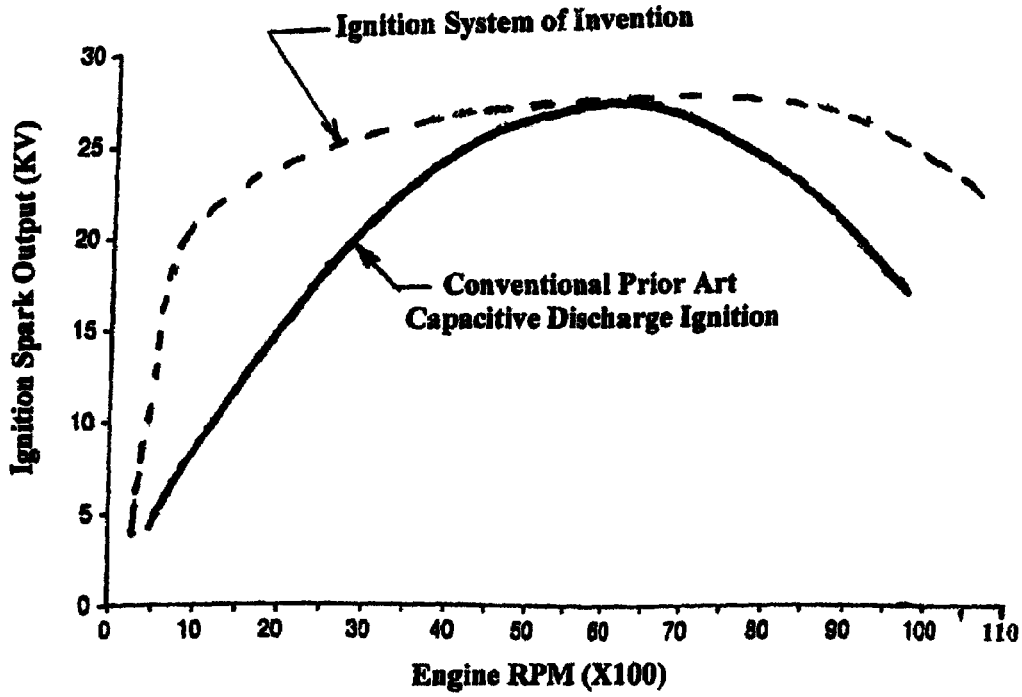
FIG. 7 is a graph illustrating a high voltage spark ignition output over a broad range of engine speeds, wherein the graph compares a light-duty internal combustion engine having an embodiment of the ignition module described herein with a comparable engine having a conventional ignition module.

According to FIG. 7, the present ignition module provides several desirable attributes over conventional prior art capacitive discharge ignition systems. First, the present ignition module generates an ignition spark output having a significantly higher voltage in a lower speed range that extends from about 300 RPM-2,500 RPM (these engine speed ranges pertain to a 2-cycle engine). Second, the ignition module described above generates ignition spark outputs with significantly higher voltages in a higher speed range that extends from about 8,000 RPM-11,000 RPM. Third, the ignition module provides improved ignition spark output over a wider engine operating range that spans from about 400 RPM to 11,000 RPM. Fourth, the above-disclosed ignition module is able to provide sufficient power for additional electrical devices, like solenoids, from the same charge coil that produces the improved ignition spark output. These are, of course, only some of the desirable characteristics of the above-described ignition module as numerous others, including both latent and patent advantages, are possible.

It is believed and will be understood by persons of ordinary skill in the art that a 4-cycle, single cylinder internal combustion engine with the ignition module described above will also have a similar significantly higher power output and similar significantly increased voltage output characteristics. This is particularly true over the RPM range at which such a 4-cycle engine operates, which is about 150 RPM to 5,000 RPM. It is believed this 4-cycle engine will have these significantly increased power and voltage outputs in both the low to moderate speed range of about 150 RPM to 2,000 RPM and high speed range of about 4,000 RPM to 5,000 RPM.

It is to be understood that the foregoing description is not a definition of the invention but is a description of one or more preferred exemplary embodiments of the invention. The invention is not limited to the particular embodiment(s) disclosed herein but rather is defined solely by the claims below. Furthermore, the statements contained in the foregoing description relate to particular embodiments and are not to be construed as limitations on the scope of the invention or on the definition of terms used in the claims, except where a term or phrase is expressly defined above. Various other embodiments and various changes and modifications to the disclosed embodiment(s) will become apparent to those skilled in the art. All such other embodiments, changes, and modifications are intended to come within the scope of the appended claims.

As used in this specification and claims, the terms "for example", "for instance," and "such as," and the verbs "comprising," "having," "including," and their other verb forms, when used in conjunction with a listing of one or more components or other items, are each to be construed as open-ended, meaning that the listing is not to be considered as excluding other, additional components or items. Other terms are to be construed using their broadest reasonable meaning unless they are used in a context that requires a different interpretation.

The invention claimed is:

1. An ignition module for use with a capacitive discharge ignition (CDI) System comprising:

a charge coil being mounted in the ignition module to induce electrical energy in response to one or more rotating magnetic element(s);

an ignition capacitor being coupled to the charge coil to receive electrical energy from the charge coil;

a first switching device being coupled in parallel with the charge coil;

a second switching device being coupled to the ignition capacitor; and an electronic processing device being coupled to the first switching device to provide it with a charge control signal and to the second switching device to provide it with a discharge control signal, wherein activation of the first switching device creates a ground path between the charge coil and ground so that electrical current flows through the parallel coupled first switching device and bypasses the ignition capacitor.

2. The ignition module of claim 1, wherein the charge coil has an inductance of about 2-10 mH, inclusive, and a resistance of about 10-50 Ω, inclusive, which helps the ignition module perform a flyback charging technique.

3. The ignition module of claim 1, wherein the first switching device has a minimum voltage rating of at least 300V and a minimum current rating of at least 1 Amp which helps the ignition module perform a flyback charging technique.

4. The ignition module of claim 1, wherein the first switching device includes a first current carrying terminal coupled between the charge coil and the ignition capacitor, a second current carrying terminal coupled to ground, and a control terminal coupled to the electronic processing device to receive the charge control signal, wherein turning the first switching device 'on' causes electrical current to flow between the first and second current carrying terminals.

5. The ignition module of claim 1, wherein the second switching device includes a first current carrying terminal coupled between the ignition capacitor and the charge coil, a second current carrying terminal coupled to ground, and a control terminal coupled to the electronic processing device to receive a discharge control signal, wherein turning the second switching device 'on' causes electrical current to flow between the first and second current carrying terminals.

6. The ignition module of claim 1, further comprising an additional electrical device, wherein electrical energy induced in the charge coil both charges the ignition capacitor and powers the additional electrical device.

7. The ignition module of claim 6, wherein the additional electrical device is a solenoid that controls an air/fuel mixture provided to a combustion chamber.

8. The ignition module of claim 1, wherein the electronic processing devices uses the charge control signal to turn 'on' the first switching device for a first stage of the charge cycle and to turn 'off' the first switching device for a second stage of the charge cycle, thereby using a flyback charging technique to charge the ignition capacitor with electrical energy induced in the charge coil.

9. A method of operating an ignition module, comprising the steps of:

(a) inducing electrical energy in a charge coil in response to one or more rotating magnetic element(s), wherein a switching device is coupled in parallel to the charge coil;

(b) shorting the charge coil with the switching device during a first stage of a charge cycle so that electrical current flows between the charge coil and ground through the parallel coupled switching device and bypasses the ignition capacitor;

(c) interrupting the short with the switching device during a second stage of the charge cycle so that electrical current flows between the charge coil and the ignition capacitor, wherein an electronic processing device controls the switching device according to an engine input signal; and (d) charging the ignition capacitor according to a flyback charging technique.

10. The method of claim 9, wherein step (b) further comprises shorting the charge coil at a time $t_0$, and time $t_0$ is calculated as a certain amount of time following a previous pulse train of the engine input signal.

11. The method of claim 9, wherein step (c) further comprises interrupting the short at a time $t_1$, and time $t_1$ is calculated from the engine input signal.

12. The method of claim 11, wherein time $t_1$ is based on a turn-off point that corresponds to a predetermined level $y_0$ on the engine input signal.

13. The method of claim 11, wherein time $t_1$ is based on a turn-off point that corresponds to a predetermined percentage of a peak signal level of the engine input signal.

14. The method of claim 11, wherein time $t_1$ is based on a turn-off point that generally corresponds to a predetermined amount of time $x_0$ following a known reference point on the engine input signal.

15. The method of claim 9, further comprises the step of:

discharging the ignition capacitor at a time $t_2$, wherein the time $t_2$ is determined according to a desired ignition timing.

16. The method of claim 9, further comprises the step of:

determining when the engine surpasses a predetermined engine speed, and if the engine surpasses the predetermined engine speed then using an uninterrupted charge cycle instead of the flyback charging technique.

17. The method of claim 9, wherein step (c) further comprises interrupting the short during a second stage of the charge cycle that begins at a time that is calculated from a current feedback signal, wherein the current feedback signal is representative of the shorted current flowing through the charge coil.

18. The method of claim 9, wherein the method is used with a 2-cycle light-duty internal combustion engine, and at least one of the steps (b) or (c) is performed while the engine is in a lower speed range that extends from about 300 RPM to 2,500 RPM.

19. The method of claim 9, wherein the method is used with a 4-cycle light-duty internal combustion engine, and at least one of the steps (b) or (c) is performed while the engine is in a lower speed range that extends from about 150 RPM to 2,000 RPM.

20. The method of claim 9, further comprises the step of:

powering an additional electrical device with electrical energy induced in the charge coil, wherein the charge coil both charges the ignition capacitor and powers the additional electrical device.

21. The method of claim 20, wherein the additional electrical device is a solenoid that controls an air/fuel mixture provided to a combustion chamber.

22. A method of operating an ignition module, comprising the steps of:

(a) inducing electrical energy in a charge coil in response to one or more rotating magnetic element(s), wherein the charge coil has a relatively low inductance of about 2-10 mH, inclusive;

(b) using a flyback charging technique to charge an ignition capacitor with electrical energy from the low inductance charge coil, wherein the flyback charging technique is used when an engine is operating in a lower speed range; and (c) using a non-flyback charging technique to power an additional electrical device with electrical energy from the same low inductance charge coil, wherein the non-flyback charging technique is used when the engine is operating in a higher speed range.

23. The method of claim 22, wherein the engine is a 2-cycle light-duty internal combustion engine, and the ignition modules uses the non-flyback charging technique when the engine is operated in a lower speed range that extends from about 300 RPM to 2,500 RPM, inclusive, and the ignition module uses the non-flyback charging technique when the engine is operated in a higher speed range that extends from about 8,000 RPM to 11,000 RPM, inclusive.

24. The method of claim 22, wherein the engine is a 4-cycle light-duty internal combustion engine, and the ignition modules uses the non-flyback charging technique when the engine is operated in a lower speed range that extends from about 150 RPM to 2,000 RPM, inclusive, and the ignition modules uses the non-flyback charging technique when the engine is operated in a higher speed range that extends from about 4,000 RPM to 5,000 RPM, inclusive.

25. A method of operating an ignition module, comprising the steps of:

(a) inducing electrical energy in a charge coil;

(b) monitoring an engine input signal with an electronic processing device, wherein the engine input signal is representative of at least one of the position or speed of an engine;

(c) shorting the charge coil during a first stage of a charge cycle so that electrical current flows between the charge coil and ground; and (d) interrupting the short during a second stage of the charge cycle so that electrical current flows between the charge coil and an ignition capacitor, wherein the electronic processing device uses the engine input signal to determine the timing for at least one of the shorting or interrupting steps.

* * * * *

UNITED STATES PATENT AND TRADEMARK OFFICE

CERTIFICATE OF CORRECTION

PATENT NO. : 7,546,836 B2
APPLICATION NO. : 12/017200
DATED : June 16, 2009
INVENTOR(S) : Martin N. Andersson et al.

It is certified that error appears in the above-identified patent and that said Letters Patent is hereby corrected as shown below:

Column 12, line 27,
Delete "Claim 25".

Signed and Sealed this

First Day of September, 2009

David J. Kappos

David J. Kappos
*Director of the United States Patent and Trademark Office*